US007340853B2

(12) United States Patent
Ching et al.

(10) Patent No.: US 7,340,853 B2
(45) Date of Patent: Mar. 11, 2008

(54) IRON WITH FABRIC CONTACT DETECTOR

(75) Inventors: Boon Khian Ching, Singapore (SG); Yong Jiang, Singapore (SG); Nyik Siong Wong, Singapore (SG); Tang Pong Har, Singapore (SG)

(73) Assignee: Koninklijke Philips Electronics N.V., Eidnhoven (NL)

( * ) Notice: Subject to any disclaimer, the term of this patent is extended or adjusted under 35 U.S.C. 154(b) by 269 days.

(21) Appl. No.: 10/521,705

(22) PCT Filed: Jul. 1, 2003

(86) PCT No.: PCT/IB03/03109

§ 371 (c)(1),
(2), (4) Date: Jan. 19, 2005

(87) PCT Pub. No.: WO2004/009898

PCT Pub. Date: Jan. 29, 2004

(65) Prior Publication Data

US 2005/0278987 A1 Dec. 22, 2005

(30) Foreign Application Priority Data

Jul. 24, 2002 (WO) ..... PCT/SG02/00165

(51) Int. Cl.
*D06F 75/10* (2006.01)
*D06F 75/38* (2006.01)

(52) U.S. Cl. ..... 38/77.5; 38/77.83; 38/93

(58) Field of Classification Search ..... 38/77.1, 38/77.3, 77.5, 77.7, 77.8, 88, 93; 219/248, 219/250, 251, 254; 356/600, 601
See application file for complete search history.

(56) References Cited

U.S. PATENT DOCUMENTS

| | | | | |
|---|---|---|---|---|
| 3,074,192 | A * | 1/1963 | Smith | 38/93 |
| 4,837,952 | A * | 6/1989 | Hennuy et al. | 38/77.7 |
| 4,980,981 | A * | 1/1991 | Naidoo | 38/1 C |
| 5,315,773 | A * | 5/1994 | Iwami et al. | 38/77.6 |
| 5,345,060 | A * | 9/1994 | Hazan et al. | 219/250 |
| 5,391,859 | A * | 2/1995 | Hazan et al. | 219/250 |

(Continued)

FOREIGN PATENT DOCUMENTS

EP 0433785 A2 6/1991

(Continued)

*Primary Examiner*—Ismael Izaguirre
(74) *Attorney, Agent, or Firm*—Paul Im

(57) ABSTRACT

An electric iron having a housing (1) and a soleplate (2) in which at least one outlet opening (10;15;34;45) is provided, means (8;19;28;39;43) for generating a fine liquid spray or foam or steam, and means (5) for delivering said generated fine liquid spray or foam or steam through said outlet opening. According to the invention, the iron is provided with detection means (12,14;22,23;35,36;49) for detecting the presence of a surface (7*a*) in the proximity of the sloplate (2) and for generating a detection signal in response to said detection, and with control means (6) for controlling the delivery of said fine liquid spray or foam or steam in response of said detection signal. For example, the detection means comprise a movable spring-loaded contact element (12) located in the soleplate (2), said element (12) activating a switch (14) for generating said signal when the soleplate is positioned against said surface (7*a*) and thus depresses said element (12).

14 Claims, 4 Drawing Sheets

U.S. PATENT DOCUMENTS

Figure 1:
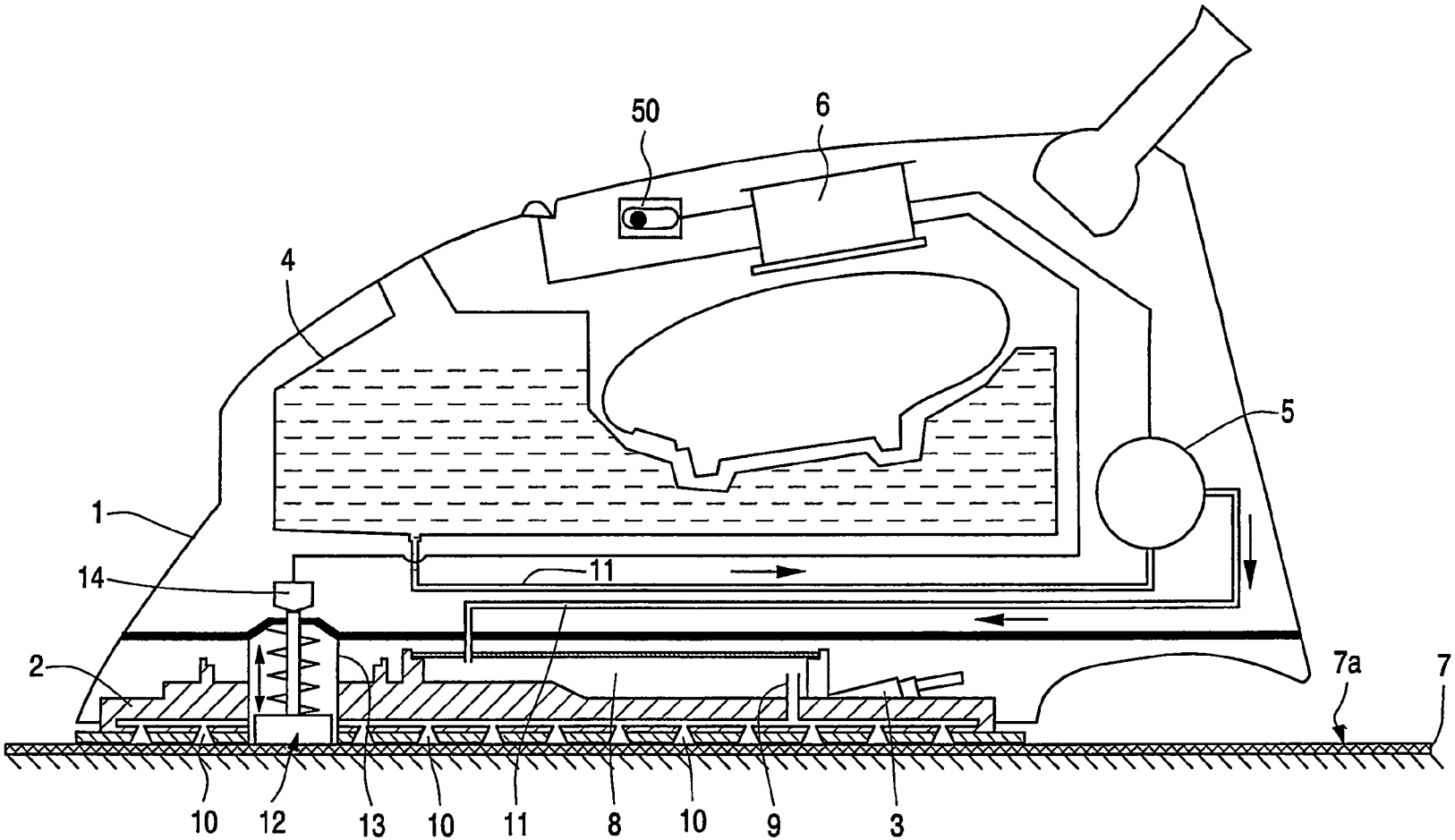

| | | | | |
|---|---|---|---|---|
| 5,642,578 | A | 7/1997 | Hazan et al. | |
| 5,642,579 | A | 7/1997 | Netten et al. | |
| 5,717,599 | A * | 2/1998 | Menhennett et al. | 700/118 |
| 5,721,418 | A * | 2/1998 | Hazan et al. | 219/257 |
| 5,731,517 | A * | 3/1998 | Ma et al. | 73/152.01 |
| 6,035,563 | A * | 3/2000 | Hoefer et al. | 38/77.1 |
| 6,079,133 | A * | 6/2000 | Netten | 38/77.7 |
| 6,286,416 | B1 * | 9/2001 | Van Der Meer | 99/293 |
| 6,384,379 | B1 * | 5/2002 | Reime | 219/257 |
| 6,438,876 | B2 * | 8/2002 | Har et al. | 38/77.7 |
| 6,891,625 | B2 * | 5/2005 | Tomita et al. | 356/601 |
| 7,040,045 | B2 * | 5/2006 | Mavinkurve et al. | 38/77.1 |

FOREIGN PATENT DOCUMENTS

| | | |
|---|---|---|
| JP | 2000070599 | 9/2000 |
| JP | 2000300899 | 2/2001 |
| WO | WO2006/106472 | * 10/2006 |

* cited by examiner

IRON WITH FABRIC CONTACT DETECTOR

The invention relates to an electric iron having a housing and a soleplate in which at least one outlet opening is provided, means for generating a fine liquid spray or foam or steam, and means for delivering said generated fine liquid spray or foam or steam through said outlet opening.

Such irons are generally known, mostly as steam irons, although instead of delivering steam, some irons are able to deliver a diluted solution of an additive liquid as a fine spray or as foam to the fabric to be ironed. Steam may be delivered by means of a steam chamber or generator in which water is vaporized, causing an overpressure that is used to expel steam through outlet openings of the soleplate. If there is to be a fine liquid spray of additive, the generated steam may be used as a carrier to release the additive. Alternatively, some irons have a pump to deliver a fine liquid spray. To initiate the delivery of steam or a fine liquid spray, the user sets or pushes a knob in the steaming or spraying position. If the iron has not yet been put in the ironing position for performing the actual ironing movements, it is possible that the generated steam or spray is delivered outside the area of the fabric to be ironed, which is undesirable. Moreover, spraying outside the area of the fabric is a waste when additive liquid is used.

An object of the invention is to improve the ironing efficiency by not starting the delivery of steam or a fine spray of additive or foam until a user actually starts the ironing process, i.e. making ironing strokes.

According to the invention, an electric iron as described in the opening paragraph is provided with detection means for detecting the presence of a surface in the proximity of the soleplate and for generating a detection signal in response to said detection, and with control means for controlling the delivery of said fine liquid spray or foam or steam in response to said detection signal. In general, the surface will be the fabric or garment to be ironed. Delivery of steam or a fine liquid spray or foam starts the moment a user puts an iron in an ironing position, i.e. when the iron is placed on the fabric. The detection means give a feedback signal to activate the release of steam or additive spray or foam. In this way the released steam or spray or foam is applied only to the fabric underneath the soleplate of the iron. In practice, the expression proximity means that the soleplate of the iron is in contact with the fabric.

In a first embodiment, the detection means comprise a movable spring-loaded contact element, said element activating a switch for generating said signal when the soleplate is positioned against said surface and thus depresses said element.

In a second embodiment, the detection means comprise resilient means provided between the housing and the soleplate, said soleplate being movable with respect to said housing against the force of said resilient means, and comprise a switch provided between the soleplate and the housing for generating said signal, said switch being activated when the iron is positioned against said surface with a force applied to the housing which is greater than the force of said resilient means.

In a third embodiment, the detection means comprise a light emitter and a photo-sensitive receiver for receiving a reflected light beam from the emitter when the soleplate is in the proximity of said surface, said surface serving as a reflection surface for the light beam, said receiver generating said signal in response to the reflected light beam.

In a fourth embodiment, the detection means comprise a pressure detector for detecting the pressure of the generated steam in a flow path between the means for generating said steam and said at least one outlet opening in the soleplate, said signal being generated in response to the pressure when the soleplate is in the proximity of said surface and when said signal exceeds a predetermined threshold value, said iron further comprising a supply tube for adding an additive liquid to the generated steam in said flow path, said supply tube having a valve which opens when said signal exceeds said predetermined threshold value.

In a further embodiment, the iron comprises motion detection means for generating a motion signal in response to a motion of the iron, said control means enabling said detection signal in response to said motion signal. Such a motion detection means may be, for example, a commercially known ball-type motion sensor. In this iron, after the detection means have given a feedback signal, the release of steam or additive spray or foam will only be activated after the motion detection means have provided a feedback signal that indicates there is a movement of the iron, preferably a movement in the ironing direction.

These and other aspects of the invention will be apparent from and elucidated with reference to the embodiments described hereinafter.

Figure 2:
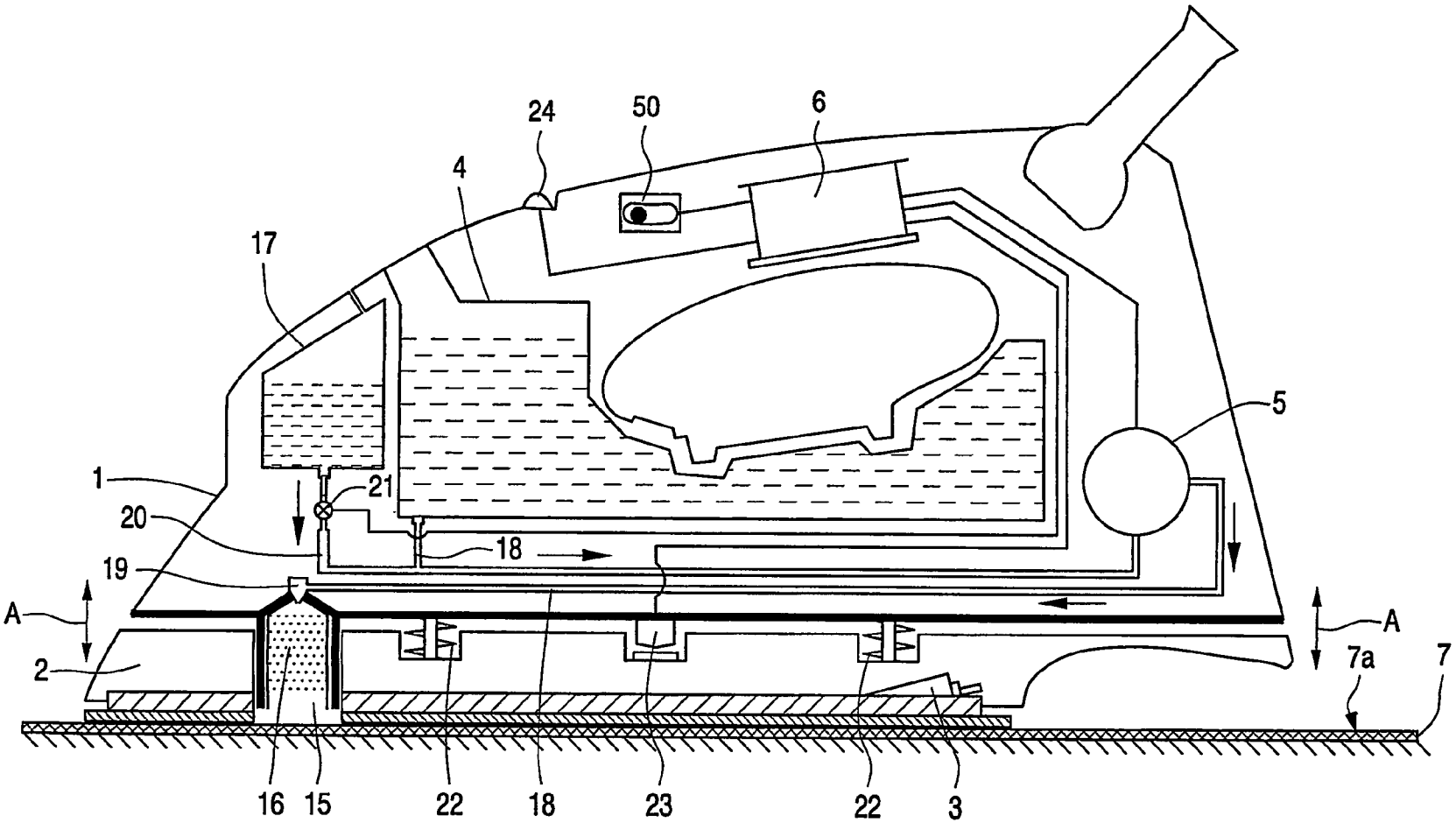
Figure 3:
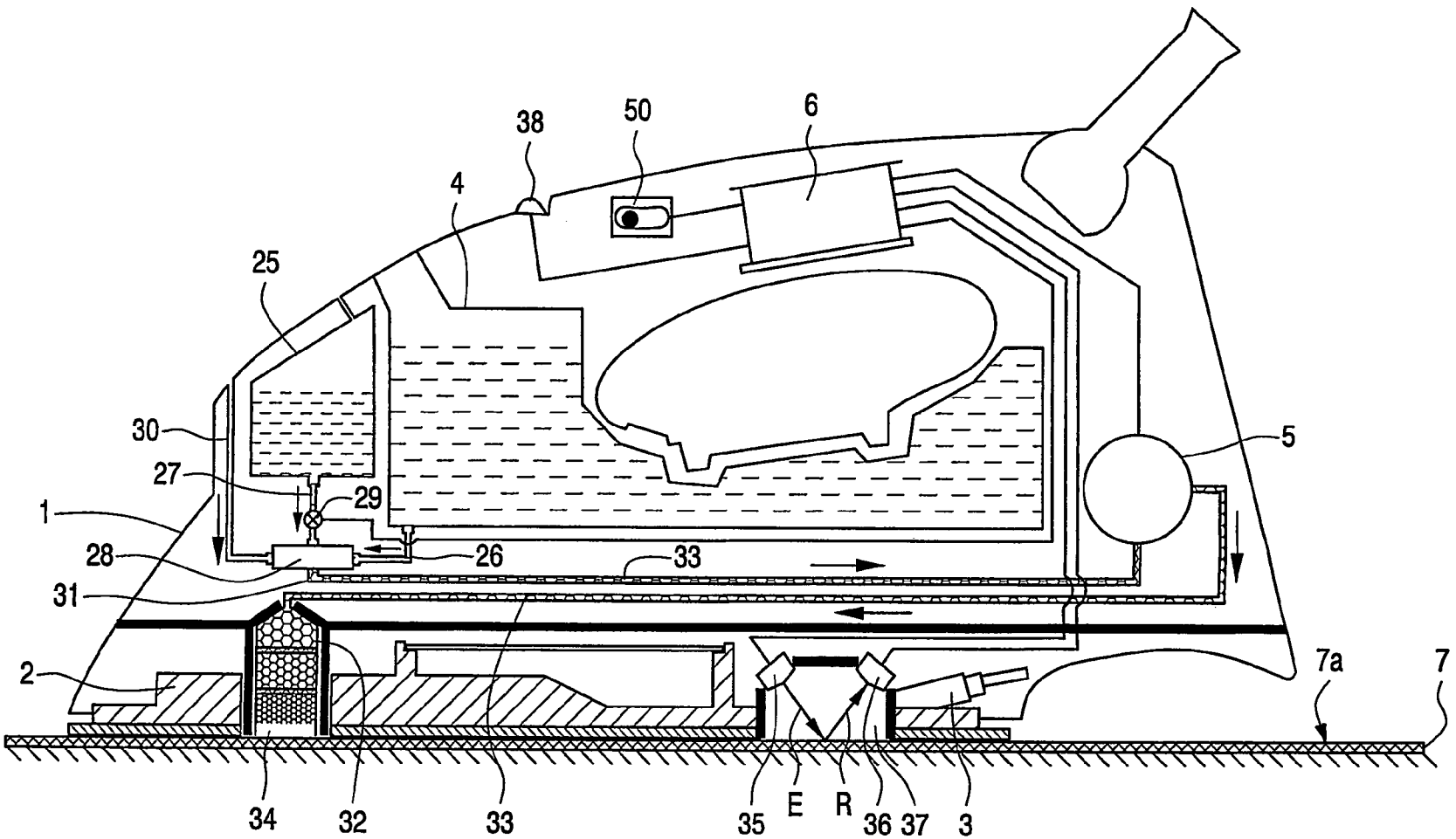
Figure 4:
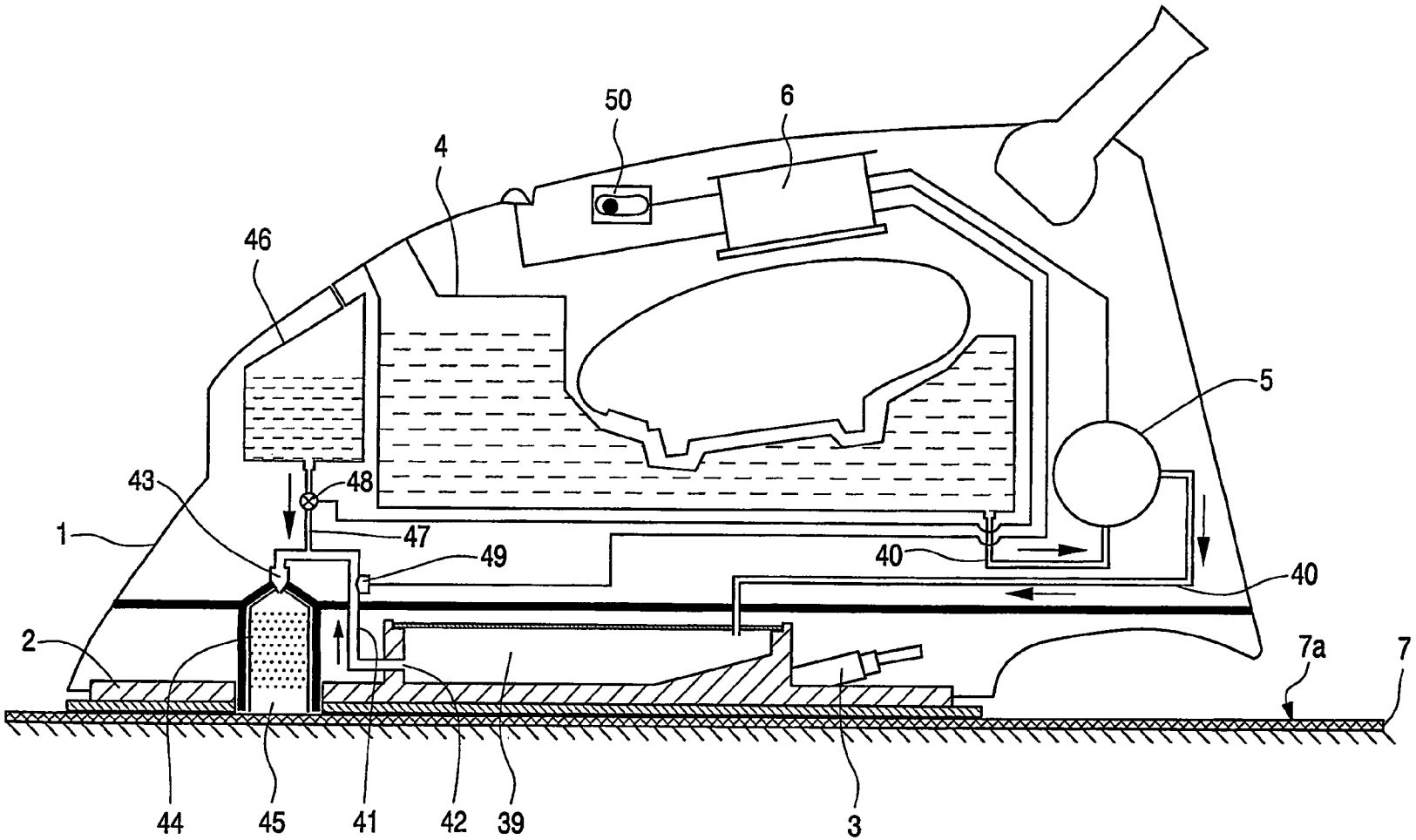

FIG. 1 shows a first embodiment of an iron with a spring-loaded contact detector in the soleplate, FIG. 2 shows a second embodiment of an iron with a spring-loaded contact detector, FIG. 3 shows a third embodiment with an IR emitter and receiver, and FIG. 4 shows a fourth embodiment with a pressure detector.

In the first embodiment shown in FIG. 1, the iron comprises a housing 1, a soleplate 2 attached to the lower side of the housing, an electric heating element 3 for heating the soleplate 2, a water reservoir 4, an electric pump 5, and a control device 6. Reference numeral 7 indicates the fabric to be ironed. The soleplate 2 is provided with a steam chamber 8 for generating steam. An outlet 9 of the steam chamber 8 is connected to a number of steam outlet openings 10 provided in the soleplate. A duct 11 connects the water reservoir 4 via a pump 5 to the steam chamber 8. A movable spring-loaded contact element 12 is provided in an opening 13 of the soleplate 2. Said contact element 12 is connected to an electric switch 14. The electric pump 5 and the electric switch 14 are electrically connected to the control device 6. The operation is as follows: assuming that the soleplate 2 is hot enough to produce steam in the steam chamber 8, the iron is positioned on the fabric 7, which causes a depression of the contact element 12. This results in an activation of the switch 14, and a signal is sent to the control device 6, whereupon the pump 5 is started. It pumps an amount of water from the water reservoir 4 through the duct 11 to the steam chamber 8 to generate steam, and an immediate delivery of steam through the outlet openings 10 is obtained. Contact element 12 may alternatively be provided behind the soleplate 2 in a housing part at the rear side of the iron.

In the second embodiment shown in FIG. 2, the iron comprises a housing 1, a soleplate 2, an electric heating element 3 for heating the soleplate 2, a water reservoir 4, an electric pump 5, and a control device 6. Reference numeral 7 indicates the fabric to be ironed. The soleplate 2 has an outlet opening 15 in which a fine spray of liquid 16 can be generated. The iron further comprises a reservoir, preferably in the form of a replaceable cartridge 17 for containing an additive liquid. A duct 18 connects the water reservoir 4 via pump 5 to a spray nozzle 19 provided in the outlet opening 15. A duct 20 connects the cartridge 17 to the duct 18 for adding an amount of additive liquid to the water flow in the duct 18. The duct 20 is provided with an electric valve 21. The soleplate 2 is movable with respect to the housing 1 in a direction perpendicular to the soleplate as indicated with arrows A. Resilient means, for example springs 22 and an electric switch 23, are provided between the soleplate 2 and the housing 1. The electric pump 5, the electric switch 23, and the electric valve 21 are electrically connected to the control device 6. The operation is as follows: when the iron is positioned on the fabric 7, the load of the housing 1, including the reservoirs, the pump, etc. exerts a force on the springs 22 which results in a depression of the springs 22, thereby activating the switch 23. A signal is sent to the control device 6, whereupon pump 5 is started and pumps an amount of water from the water reservoir 4 through the duct 18 to the spray nozzle 19 to generate a fine spray of water or mist. If the user wants to add an amount of additive liquid to the spray, the electric valve 21 can be opened, for example by operating the knob 24 on the housing to send a signal via the control device 6 to the valve.

In the third embodiment shown in FIG. 3, the iron comprises a housing 1, a soleplate 2, an electric heating element 3 for heating the soleplate 2, a water reservoir 4, an electric pump 5, and a control device 6. Reference numeral 7 indicates the fabric to be ironed. The iron further comprises a reservoir in the form of a replaceable cartridge 25 for containing a foaming liquid in concentrated form. The foaming liquid comprises a small amount of surfactant to reduce the surface tension. Ducts 26 and 27 of the water reservoir 4 and the cartridge 25 are connected to a foaming device 28. The duct 27 is provided with an electric valve 29. The foaming device 28 further has an inlet 30 for air. An outlet 31 of the foaming device is connected via the pump 5 to a cavity 32 through a duct 33. The cavity 32 has a discharge opening 34 provided in the soleplate 2. The soleplate 2 is further provided with an infrared emitter 35 and an infrared-sensitive receiver 36 arranged in a cavity 37 of the soleplate, which is open toward the fabric 7. The electric pump 5, the infrared emitter 35 and receiver 36, and the electric valve 29 are electrically connected to the control device 6. The operation is as follows: the infrared emitter 35 sends a light beam as indicated with arrow E when the iron is switched on. If the iron is positioned on the surface 7*a* of the fabric 7 or if the soleplate 2 is at least in the proximity of the fabric 7, the light beam E is reflected by the surface 7*a* of the fabric 7 and the reflected light beam R is received by the infrared-sensitive receiver 36. The receiver generates a signal which is sent to the control device 6, whereupon the pump 5 is started to draw water, foaming liquid, and air into the foaming device 28, thereby generating foam. The foam is pumped to the cavity 32, which serves as an expansion device for the foam, i.e. to generate more bubbles. To control the degree of foaming, the amount of foaming liquid supplied to the foaming device 28 can be adjusted by the electric valve 29 which is operable, for example, by the knob 38.

In the fourth embodiment shown in FIG. 4, the iron comprises a housing 1, a soleplate 2, an electric heating element 3 for heating the soleplate 2, a water reservoir 4, an electric pump 5, and a control device 6. Reference numeral 7 indicates the fabric to be ironed. The soleplate 2 is provided with a steam chamber 39 for generating steam. A duct 40 connects the water reservoir 4 via pump 5 to the steam chamber 8. An outlet duct 41 connects a steam outlet 42 of the steam chamber 39 to a nozzle 43 provided in a cavity 44 in the soleplate 2. The lower end of the cavity comprises the outlet opening 45. The iron further comprises a reservoir, preferably in the form of a replaceable cartridge 46 for containing an additive liquid. A supply duct 47 connects the cartridge 46 to the outlet duct 41 for adding additive liquid to the steam. The additive flow can be controlled by means of an electric valve 48 provided in the duct 47. The outlet duct 41 is provided with a pressure detector 49 for detecting the pressure of the steam in the outlet duct 41. The electric pump 5, the pressure detector 49, and the electric valve 48 are electrically connected to the control device 6. The operation is as follows: assuming that the soleplate 2 is hot enough to produce steam in the steam chamber 8, the pump is started and water is pumped through duct 40 to the steam chamber 8, where steam is generated. The generated steam builds up a pressure in the outlet duct 41, which is sensed by the pressure detector 49. When the generated detection signal exceeds a predetermined threshold value, a signal is sent to the control device 6, whereupon the electric valve 48 is opened and adds an amount of additive liquid to the steam to obtain a fine spray of steam with additive.

The iron as described in all above-mentioned embodiments may also be provided with a motion sensor (50), for example, a well-known ball-type motion sensor. Such a motion sensor generates a motion signal in response to certain movements of the iron. These are preferably movements in the ironing direction. Thus the motion signal is generated when a user starts to make a to-and-fro ironing movement. The delivery of spray, foam, or steam will only take place in such an iron when the control means (6) receive a detection signal and a motion signal.

The claimed iron according to the invention may also be an iron suitable for use in an so-called ironing system, which comprises a stand and an electric iron, said stand being provided with a water reservoir and boiler. Steam generated in the boiler is delivered to the iron through a flexible tube.

The invention claimed is:

1. Electric iron comprising a housing and a soleplate in which at least one outlet opening is provided, means for generating a fine liquid spray or foam or steam, and means for delivering said generated fine liquid spray or foam or steam through said outlet opening, characterized in that the iron further comprises detection means for non-thermally detecting the presence of a surface in the proximity of the soleplate and for generating a detection signal in response to said detection, and control means for controlling the delivery of said fine liquid spray or foam or steam in response to said detection signal.

2. Electric iron as claimed in claim 1, characterized in that the detection means comprise a movable spring-loaded contact element (12), said element (12) activating a switch (14) for generating said signal when the soleplate is positioned against said surface (7*a*) and thus depresses said element (12).

3. Electric iron as claimed in claim 2, characterized in that the iron comprises motion detection means (50) for generating a motion signal in response to a motion of the iron, said control means (6) enabling said detection signal in response to said motion signal.

4. Electric iron as claimed in claim 1, characterized in that the detection means comprise resilient means (22) provided between the housing (1) and the soleplate (2); said soleplate being movable with respect to said housing against the force of said resilient means, and comprise a switch (23) provided between the soleplate and the housing for generating said signal, said switch (23) being activated when the iron is positioned against said surface (7*a*) with a force applied to the housing which is greater than the force of said resilient means (22).

5. Electric iron as claimed in claim 4, characterized in that the iron comprises motion detection means (50) for generating a motion signal in response to a motion of the iron, said control means (6) enabling said detection signal in response to said motion signal.

6. Electric iron as claimed in claim 1, characterized in that the detection means comprise a light emitter and a photosensitive receiver for receiving a reflected light beam from the emitter when the soleplate is in the proximity of said surface, said surface serving as a reflection surface for the light beam, said receiver generating said signal in response to the reflected light beam.

7. Electric iron as claimed in claim 6, characterized in that the iron comprises motion detection means for generating a motion signal in response to a motion of the iron, said control means enabling said detection signal in response to said motion signal.

8. Electric iron as claimed in claim 1, characterized in that the detection means comprises a pressure detector (4) for detecting the pressure of the generated steam in a flow path (41) between the means (39) for generating said steam and said at least one outlet opening (45) in the soleplate (2), said signal being generated in response to the pressure when the soleplate is in the proximity of said surface (7*a*) and when said signal exceeds a predetermined threshold value, said iron further comprising a supply duct (47) for adding an additive liquid to the generated steam in said flow path (41), said supply duct (47) having a valve (48) which opens when said signal exceeds said predetermined threshold value.

9. Electric iron as claimed in claim 8, characterized in that the iron comprises motion detection means (50) for generating a motion signal in response to a motion of the iron, said control means (6) enabling said detection signal in response to said motion signal.

10. Electric iron as claimed in claim 1, characterized in that the iron comprises motion detection means for generating a motion signal in response to a motion of the iron, said control means enabling said detection signal in response to said motion signal.

11. An electric iron, the electric iron including a soleplate and an outlet opening associated with the soleplate, the electric iron comprising:

provision means for providing, at least one ironing substance via the outlet opening;

detection means for non-thermally detecting the presence of a surface proximate to the soleplate; and, control means for controlling said provision means responsive to said detection means non-thermally detecting the presence of the surface.

12. An electric iron as claimed in claim 11, further comprising motion detection means for detecting a motion of the iron, and wherein, responsive to said motion detection means detecting the motion, said provision means is further controlled in providing the at least one ironing substance via the outlet opening.

13. An electric iron as claimed in claim 11, wherein said provision means is configured to provide, via the outlet opening, one or more of (a) steam, (b) foam, (c) additive liquid, (d) water, or (e) a combination of "(a")-"(d)".

14. An electric iron as claimed in claim 11, wherein said provision means comprises generating means for generating the at least one ironing substance and delivering means for delivering the so-generated, at least one ironing substance.

* * * * *